US006036050A

United States Patent [19]

Ruane

[11] Patent Number: 6,036,050

[45] Date of Patent: Mar. 14, 2000

[54] STOP MOTION HINGE FOR A GARBAGE CAN

[76] Inventor: John T. Ruane, 2124 E. 72 St., Brooklyn, N.Y. 11234

[21] Appl. No.: 09/199,444

[22] Filed: Nov. 25, 1998

[51] Int. Cl.[7] ..... B65D 43/24

[52] U.S. Cl. ..... 220/831; 220/908; 16/334

[58] Field of Search ..... 220/831, 832, 220/827, 830, 833–835, 908, 4.22; 16/334, 337, 332

[56] References Cited

U.S. PATENT DOCUMENTS

| | | | |
|---|---|---|---|
| 1,687,174 | 10/1928 | Mountford et al. | 16/334 |
| 2,922,669 | 1/1960 | Hansen | 16/334 |
| 3,272,379 | 9/1966 | Driza et al. | 220/832 |
| 4,087,885 | 5/1978 | Gillentine | 16/334 |
| 5,141,124 | 8/1992 | Smith et al. | 220/832 X |
| 5,507,013 | 4/1996 | Weadon et al. | 16/334 |
| 5,511,807 | 4/1996 | Snyder | 220/832 X |

*Primary Examiner*—Nathan Newhouse
*Attorney, Agent, or Firm*—John P. Halvonik

[57] ABSTRACT

A stop motion hinge for use on garbage cans utilizes a spring loaded hinge for stop motion of the lid. A spring loaded washer or plate with a series of bumps abuts the sides of the hinge. The sides of the hinge member have a series of apertures to allow the bumps to protrude through. The base member in connection with the hinge also has a series of apertures corresponding to the bumps so that as the hinge is moved, the pressure of the washer will force the bumps to lock into the set of apertures so that the hinge will form a fixed connection with base member when the lid is raised. The hinge is used on garbage cans in connection with the lid so that a lid with stop motion function is created. The hinge is preferably attached by a pop rivet to make installation easy.

2 Claims, 2 Drawing Sheets

STOP MOTION HINGE FOR A GARBAGE CAN

BACKGROUND OF THE INVENTION

1. Field of the Invention

The invention relates to the field of garbage cans and in particular to an improved hinge for use on garbage cans and having a stop action function in order to allow a garbage can lid to remain in open position after the user lifts it open.

It is observed that garbage can lids have to be held open by the user in order for them to function. Such requires manual effort on the part of the user so that the lid is open when he/she is throwing garbage in the can. This often makes it difficult for the user to use since he/she may have a large load of garbage and having to hold open the garbage can is difficult.

It is believed that by providing a stop action hinge for use on garbage cans such problems can be alleviated. Such a hinge will allow the user to lift up on the garbage can lid once and then provide for the lid to remain in an open position without any further actions on the part of the user. In this particular invention, the lid will be held open by the action of a spring loaded washer in connection with arms of cradle of the hinge. Once the user has finished adding garbage to the can, he/she can turn down the lid by pushing it down. Such minimum effort is all that is necessary in order to turn down the lid.

2. Description of the Prior Art

While there are hinges used in garbage cans, none of them are of the same construction as the applicant's nor are such stop action hinges known to be used in connection with garbage can lids.

SUMMARY OF THE INVENTION

The invention is an improved stop motion hinge for use on garbage cans. An extension piece in connection with the garbage can lid pivots in relation to the base member attached to the side of the garbage can. The base portion of the hinge has a cradle portion in order to support the connecting piece that attaches the lid to the side of the can. The connecting piece is attached to the lid and the base is attached to the side of the garbage can by a pop rivet.

A spring loaded washer or plate is used in between the arms of the extension piece. Both the cradle of the hinge and the arms of the extension piece have a series of apertures so that a series of bumps on the plate will lock the cradle and arms together when the lid is raised. The plate will urge the bumps outward through the apertures in the arms and into the apertures of the cradle so that the lid and can will form a fixed connection once the lid is raised. Thus a garbage can with stop motion function is created. Both parts of the hinge viz.: the base and the extension piece, may be attached to existing garbage cans by means of pop rivets for ease of installation on existing garbage cans.

It is an object of the invention to provide an efficient stop motion hinge for garbage can lids in order that garbage cans may be held open when depositing garbage and then returned to a closed position.

Another objective is to provide a stop motion hinge that can easily be retrofitted onto existing garbage cans with a minimum of effort and expense.

Other advantages of the invention should be readily apparent to those skilled in the art once the invention has been described.

DESCRIPTION OF THE PREFERRED EMBODIMENT

Figure 1:
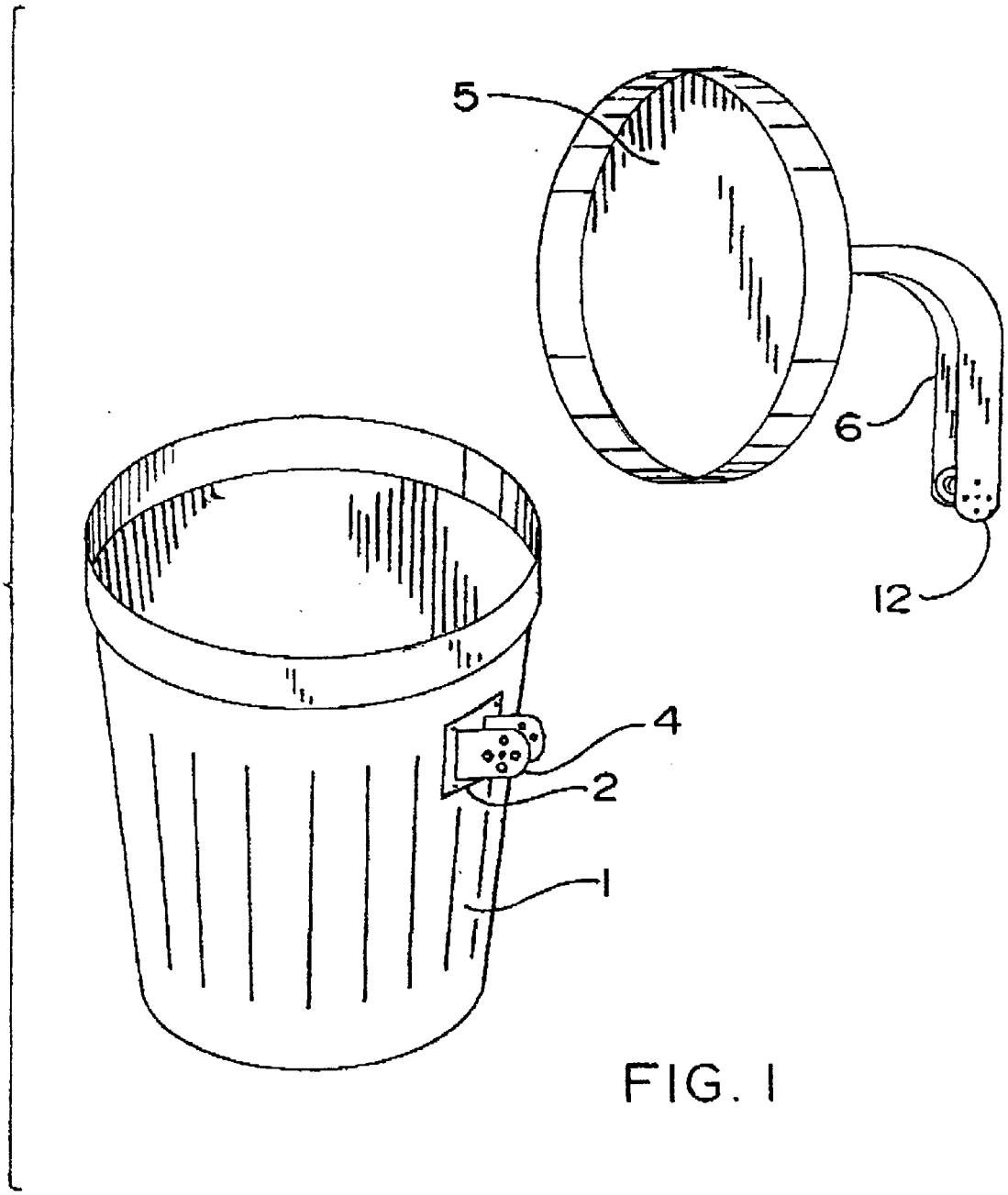
FIG. 1 Overall construction of hinge and support arms.
Figure 2:
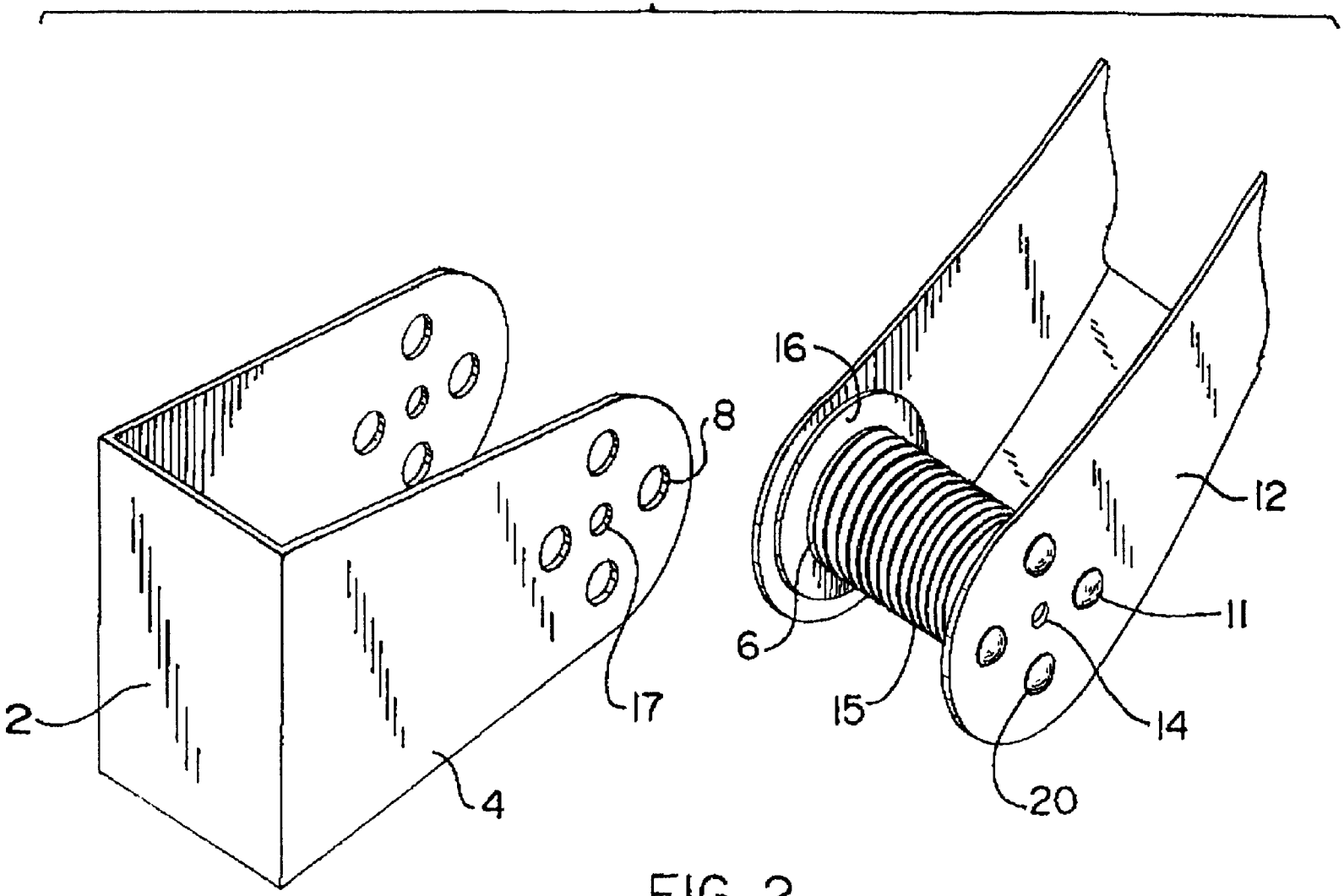
FIG. 2 blow apart view of hinge and arms.

The apparatus is essentially two parts that are connected to one another in the manner of a hinge so that the extension piece will pivot in relation to the base of the hinge. The overall construction of the apparatus is as shown in FIG. 1. There is a hinge base 2 in connection with the side wall of garbage can 1. The hinge base has a pair of cradle arms 4 extending outward from the base in order to support a connecting piece 6 that forms a hinge. At the end of the cradle are a series of apertures (8), preferably four apertures, so that bumps 11 in the plate 16 will protrude through the apertures 20 as well as the apertures 8 in the base and so hold the lid in an open position when the lid is moved upward.

The extension piece is shown as 6 and is in connection with the garbage can lid 5. The extension piece has a pair of spaced apart arms 12 that extend from the piece so that they will fit in the space between the cradle arms and can be connected to the cradle by means of the connecting piece 7 so as to form a hinge. There should be a main hole 14 in each extension arm so that the extension piece may be connected to the main bore 17 of the cradle by an axle or similar means (the axle not shown).

Thus a connecting piece will be placed in connection with central bore hole 14 and 17 of both extension piece and cradle so that the extension piece will move in relation to the cradle. Thus a hinge is provided between the lid and the can so that the lid can pivot in relation to the can. Other connection means that provide for hinge like motion may be used with out varying from the spirit of the invention.

The arms 12 of the extension piece should have a connecting piece 7 located between them at one end. This is the end that is placed in the cradle. The extension arms should be slightly less wide than the cradle so that it might fit in between the arms of the cradle. A spring 15 and a plate 16 (similar to a washer) the plate will be at each end of the connecting piece 7 and in connection with the inner surface of the arm 12. The spring 15 can be attached around the connecting piece 7. There are series of holes 20 in at least one of the arms 12 and there are preferably four holes. These are sized and shaped so as to correspond with the apertures 8 in the cradle. The raised bumps 11 in the plates 16 will protrude through the holes 20 and interact with the holes 8 in the base to lock the lid in plcae. The bumps may be stamped out of the same metal as the plates and can be a raised up part of the metal surface of the plate.

The resulting arrangement will provide a spring loaded washer or plate that is being urged outward by the action of the spring. Such action will force the bumps 11 on the plates to interact with the apertures 8 so that as the lid is being raised the spring will urge the bumps outward and the bearings will engage the apertures 8 and so allow the lid to be locked in an open position without any further effort on the part of the user.

The spring force is not so great that the user cannot lower the lid by using manual labor. The spring is simply there to support the lid in an open position and should have enough force in order to maintain the lid in an open position. When the user is done emptying garbage into the can he/she can snap the lid down manually.

Pop rivets should be used in order to secure the base 2 of the hinge to the side of a garbage can 1. Pop rivets should also be used in connection with the extension piece in order to secure the lid 5 to the extension piece. The use of pop rivets is believed to provide for an attachment process that is faster and easy for a consumer. It is thought that this would aid greatly in the ability to retrofit existing garbage cans with this stop motion type of hinge.

It is preferred that the hinge and other components be made of metal. Galvanized steel is one material that may find usefulness in the invention. Other materials, such as aluminum, plastic, stainless steel, brass and copper may also be used without violating the spirit of the invention.

I claim:

1. The combination of a garbage can and corresponding lid in connection with a stop action hinge, said hinge comprising a base member in connection with a side wall of said can and an extension portion in connection with said lid, said base portion having a cradle comprising a pair of spaced apart cradle arms, at least one of said cradle arms having a first series of apertures, said extension portion having a pair of extension arms, said extension arms spaced apart a distance adapted to fit between said cradle arms so that each said extension arm will have an outer surface in close connection with said cradle arm and an inner surface opposite said outer surface, said extension portion connected to said cradle by a hinge means so as to provide pivotal motion between said extension piece and said cradle, a spring and at least one plate located between said extension arms so that said spring will urge said plate against said inner surface of at least one said cradle arm, said plate having a series of raised bumps, at least one of said extension arms having a second series of apertures corresponding in size and shape to said first series of apertures, so that said bumps will fit into both said series of apertures when said lid is moved in relation to said can.

2. The combination of claim 1 wherein said base member is attached to said wall of said garbage can by pop rivets.

* * * * *